US005398993A

United States Patent [19]

Chen

[11] Patent Number: 5,398,993

[45] Date of Patent: Mar. 21, 1995

[54] FRAME BODY STRUCTURE OF ELASTIC ARCUATE CUSHION

[75] Inventor: Hwei-Len Chen, Taipei, Taiwan, Prov. of China

[73] Assignee: Formosa Saint Jose Corporation, Tapei, Taiwan, Prov. of China

[21] Appl. No.: 1,661

[22] Filed: Jan. 7, 1993

[51] Int. Cl.[6] ..... A47C 7/42

[52] U.S. Cl. ..... 297/230.11; 297/452.64; 5/643; 5/900.5

[58] Field of Search ..... 297/230.11, 230.13, 297/452.18, 452.56, 452.64, 452.63; 5/643, 900.5

[56] References Cited

U.S. PATENT DOCUMENTS

| | | | |
|---|---|---|---|
| D. 202,541 | 10/1965 | Borrelli | 5/900.5 X |
| 958,502 | 5/1910 | Kennedy | 5/643 X |
| 1,412,037 | 4/1922 | Beynon | 297/230.11 X |
| 4,002,368 | 1/1977 | Ortize | 297/452.64 X |
| 4,192,547 | 3/1980 | Geier | 297/452.63 |
| 4,367,897 | 1/1983 | Cousins | 297/452.63 X |
| 5,190,347 | 3/1993 | Shiow-Lan | 297/230.11 X |

FOREIGN PATENT DOCUMENTS

| | | | |
|---|---|---|---|
| 469226 | 5/1992 | European Pat. Off. . | |
| 1176390 | 4/1959 | France | 297/230.11 |
| 939343 | 10/1963 | United Kingdom | 297/452.56 |

OTHER PUBLICATIONS

Mile Kimball Company, Dec. 1990 catalogue, p. 58.

*Primary Examiner*—Kenneth J. Dorner
*Assistant Examiner*—David E. Allred
*Attorney, Agent, or Firm*—Young & Forward

[57] ABSTRACT

The frame of an elastic arcuate cushion according to the present invention consists of four frame plates molded integrally, and shaped to conform with the arcuate human body. The frame is provided with a plurality of longitudinal or transverse guide holes for threads that support large numbers of closely spaced beads in the space circumscribed by the frame. The thread-supported beads provide a cushion that has a full elasticity and an elevational shaping and curvature conforming to the arcuate human body, such that the user can feel comfortable when he sits and leans on the cushion.

1 Claim, 7 Drawing Sheets

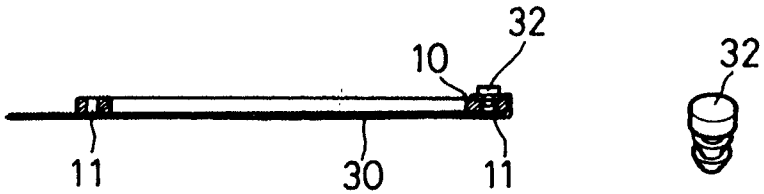
FIG. 10
FIG. 10A
FIG. 2B
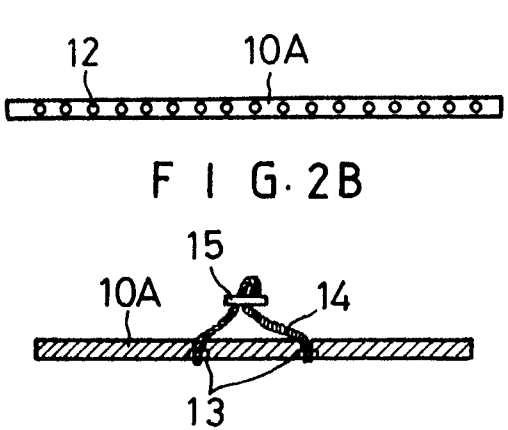
FIG. 2E
FIG. 2C
FIG. 2D
FIG. 2A
FIG. 5

FRAME BODY STRUCTURE OF ELASTIC ARCUATE CUSHION

BACKGROUND OF THE INVENTION

The seats in the conventional car in general are provided with seat and back cushions for the users' sitting and leaning thereon so that the cushions feel soft and comfortable. However the comfortable feeling of these cushions chiefly depends on the status of back cushion coinciding with the human body spine when the back cushion contacts the human body spine. Since the human body spine supports the whole weight of the human body and head, if one's spine is in a poor state of bending for a long time, he will experience lumbago, back pain and sore head and neck.

The conventional cushion (such as the back cushion) is composed of a soft sponge adhered onto a piece of fixed hard plate. So far as this fixed cushion is concerned, when the human body spine leans thereon, the spine will always have to meet with the established fixed pattern thereof, and then will be subject to the restraint of said pattern, so the user will feel uncomfortable and his health will be unfavorably affected (such as suffering herniation of interverbral disc).

In addition, the plate surface of the conventional cushion (such as a back cushion) is a flat plate without any arcuate shaping, so when one's body leans on the flat plate cushion, the arcuate part of his spine cannot coincide with the plate surface, and his spine cannot be properly supported. Therefore, so far as those who have to stay in the car for a long time are concerned, the cushion becomes very uncomfortable; additionally, since the plate surface of a conventional cushion is airtight, the user's back tends to sweat so as to add to his discomforture.

SUMMARY OF THE INVENTION

In view of the foregoing drawbacks of the conventional cushion, the present inventor has designed a frame body structure with elastic arcuate cushion which is aimed at the following: the cushion with the said frame body structure is characterized by a hollow porous construction, a full elasticity and can conform with the arcuate shaping of the human body, so when the human body leans on the cushion, the body can coincide with the cushion most closely so that the user will feel very comfortable.

The frame body structure of an elastic arcuate cushion according to the present invention is characterized by the following: the frame body structure of said cushion consists of two sets of corresponding frame plates, up and down, and left and right moulded integrally, the said two sets of corresponding frame plates being shaped to meet with the arcuate human body. The central space surrounded by the frame plates is hollow but not plane, and the plates are provided with a plurality of longitudinal and transverse guide holes for knitting the cushion body with beads or other textile in the central space so that the knitted cushion with a full elasticity and an elevational shaping and curve can conform to the shape of the arcute human body, and the user can feel comfortable when he leans on the cushion.

BRIEF DESCRIPTION OF THE DRAWINGS

FIG. 2A is a side view of the frame body structure shown in FIG. 1.

FIG. 2B is top view of the frame body structure shown in FIG. 1.

FIG. 2C is a fragmentary sectional view of a transverse guide hole taken along the line 2C—2C in of FIG. 2.

FIG. 2D is a fragmentary view of a longitudinal guide hole taken along the line 2D—2D in FIG. 2.

FIG. 2E is a structural view of the frame body structure and fastener rope of the present invention.

FIG. 5 is an enlarged schematic view of longitudinally threading the beads with two thread terminals, using "crossing pinching" according to the present invention.

FIG. 10 is a sectional view taken along the line 10—10 FIG. 9.

FIG. 10A is a schematic view of barded spikes used in the FIG. 8 according to the present invention.

DETAILED DESCRIPTION

Figure 1:
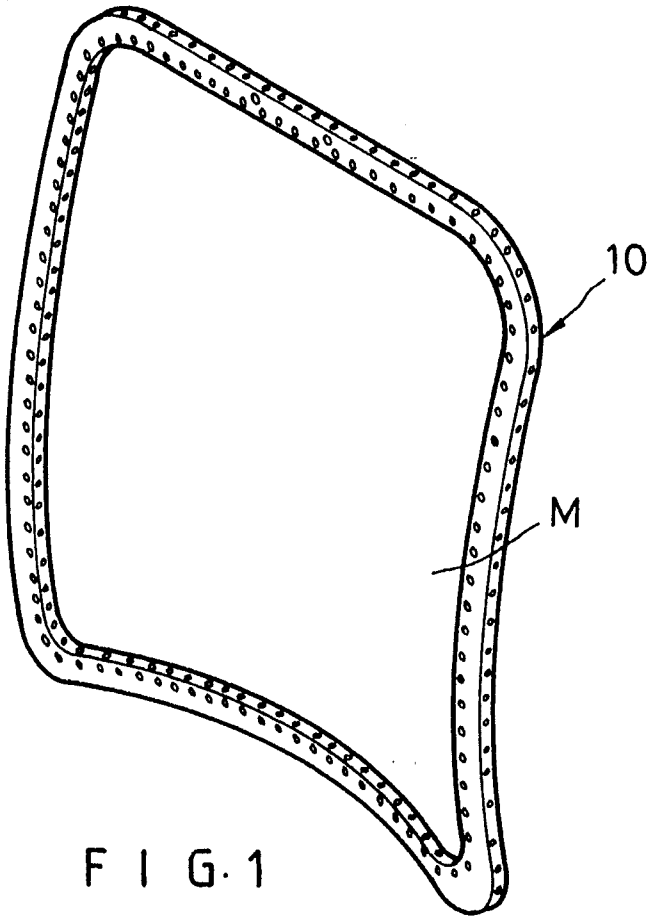
FIG. 1 is an elevational perspective view of a frame body structure of the present invention.
Figure 2:
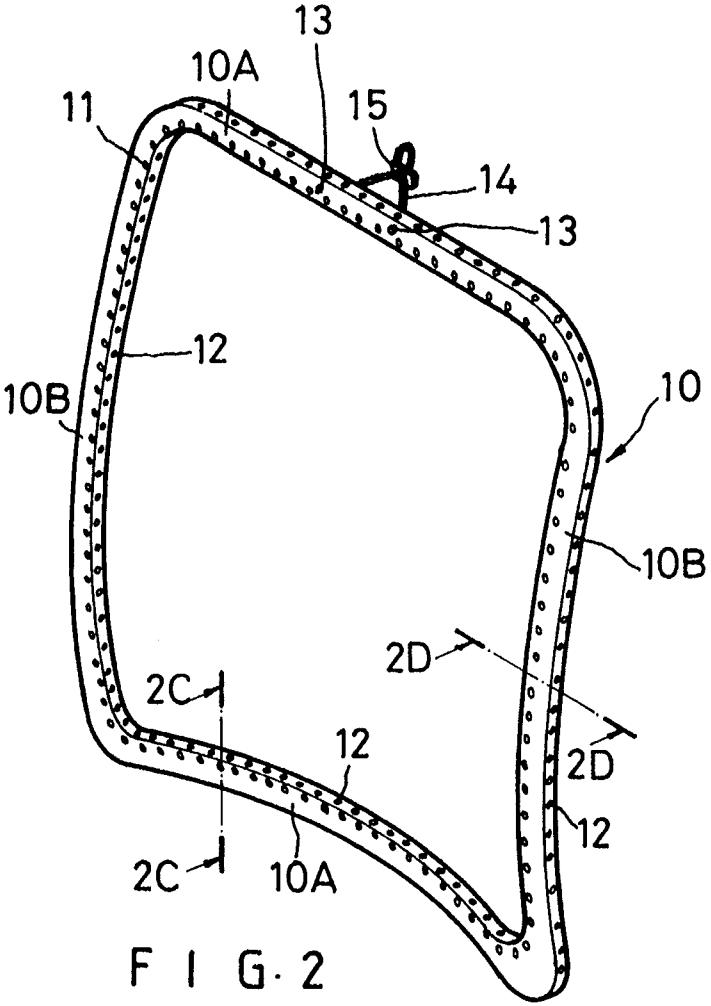
FIG. 2 is a schematic view of construction of frame body structure of the present invention.

As shown in FIG. 1 and 2, the frame body structure (10) consists of a set of upper and lower frame plates (10A) and another set of left and right frame plates (10B). These upper and lower frame plates (10A) and left and right frame plates (10B) are in a symmetrical state respectively. As shown in FIG. 2A and 2B, these two sets of frame plates have a curve meeting with the arcuate human body (such as the spine, cervical spine and waist); the central part surrounded by the said two sets of frame plates (10A), (10B) forms a hollow part (M) which is not planar.

As shown in FIG. 2, 2A, 2B, 2C and 2D, a plurality of longitudinal guide holes (11) and transverse guide holes (12) are provided in each frame plate of frame body structure (10) in the vertical and horizontal directions of the surface of said plate respectively. Through these holes, tenacious threads L can be extended to string beads 16 or various cloth (such as jean, synthetic leather, non-woven cloth or network cloth) to finish in integral cushion (such as a back cushion, waist-protecting cushion or pillow cushion) to be used by the user.

As shown in FIG. 2D, the said transverse guide hole (12) is outward tapered so that the tenacious thread tends to pass through it such that the attachment of beads 16 to body structure 10 can be more effective.

As shown in FIG. 2E and 2, two outward tapered through holes (13) are separately provided in frame plate (10A) so as to install a fastener rope (14). A clip 15 is provided on rope 14 to fix said cushion onto the pillow of the seat in the car and to adjust the position of said cushion up and down.

Figure 4:
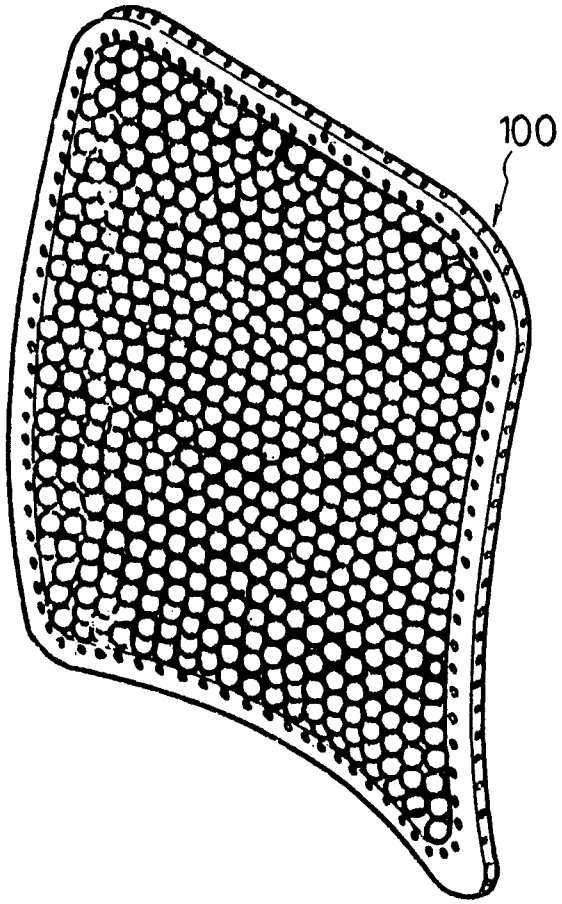
FIG. 4 is an elevational view of a finished beaded cushion of the present invention.
Figure 3:
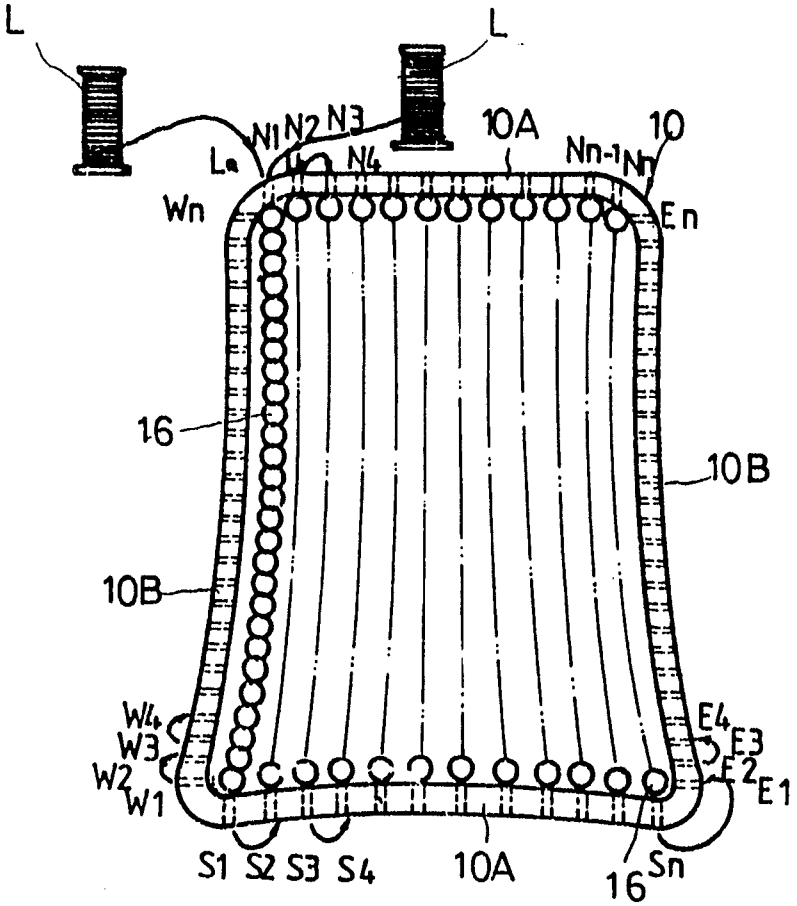
FIG. 3 is a schematic view of the frame body structure of the present invention during the process of threading beads thereon.

To assemble a cushion on the frame body structure (10) the procedure shown in FIG. 3, 4 and 5 may be followed. The process of kniting the beaded cushion (100) is as follows: firstly insert the two terminal portions La and Lb of two tenacious threads L in the position N1 of the first transverse guide hole (12) of the upper frame plate (10A), and then dispose the required beads (16) on these two terminals La and Lb, and then let these two terminals La and Lb pass out from the position S1 of the first transverse guide hole of the lower frame plate (10A) to finish the knitting of the first series of longitudinal beads; then insert the said two terminal portions La and Lb in the position S2 of the second transverse guide hole of the lower frame plate (10A), to dispose the beads (16) with equal number on these two terminal portion La and Lb, to let these two terminals La and Lb pass out from the position N2 of the second transverse guide hole of the upper frame plate 10A to finish the longitudinal knitting of the second series of beads; and in such a sequence, to insert these two terminals La and Lb in the positions S3, S4, N4, . . . Nn, Sn from the positions N3, S3, S4, . . . Nn-1, Nn, and meantime, during the threading, the required beads are disposed on these two terminals La and Lb one after another so as to finish the longitudinal knitting of beaded cushion (100).

As shown in FIG. 3, 4, and 5, when the longitudinal knitting of the beaded cushion (100) is finished, the two terminal portions La and Lb may be inserted in the position E1 of the first transverse guide hole (12) of right frame plate (10B), the to dispose a bead (16) on these two terminals La and Lb and to thread the beads in the longitudinal direction in the manner of "crossing pinching". Then a bead is disposed on these two terminals La and Lb which thread the next series of beads in the transverse direction in the same manner of "crossing pinching", and in such a sequence, the transverse knitting of the first series of beads is finished; then these two terminals La and Lb are passed out from the position W1 of the first transverse guide hole of left frame plate (10B) and inserted in the position W2 of the second transverse guide hole to proceed with the knitting of the second series of beads in the transverse direction; and in such a sequence, to insert these two terminal portions La and Lb are inserted in the positions E2, E3, W3, W4, . . . En, Wn from the positions W2, E2, E3, W3, . . . En-1, Wn, and finally, these two terminal positions La and Lb are tied down so as to finish the knitting of beaded cushion (100); So far as the finished beaded cushion is concerned, the two terminal portions La and Lb for transverse knitting are in a state of "crossing pinching" the threads for longitudinal knitting, it is aimed at mutually tightening up each adjoining bead without displacement and mutually stretching the finished knitted cushion which can further form a shaping with a curve to meet with the human body, so that when the user sits and leans thereon, he will feel its coincident performance and quite comfortableness.

Figure 6:
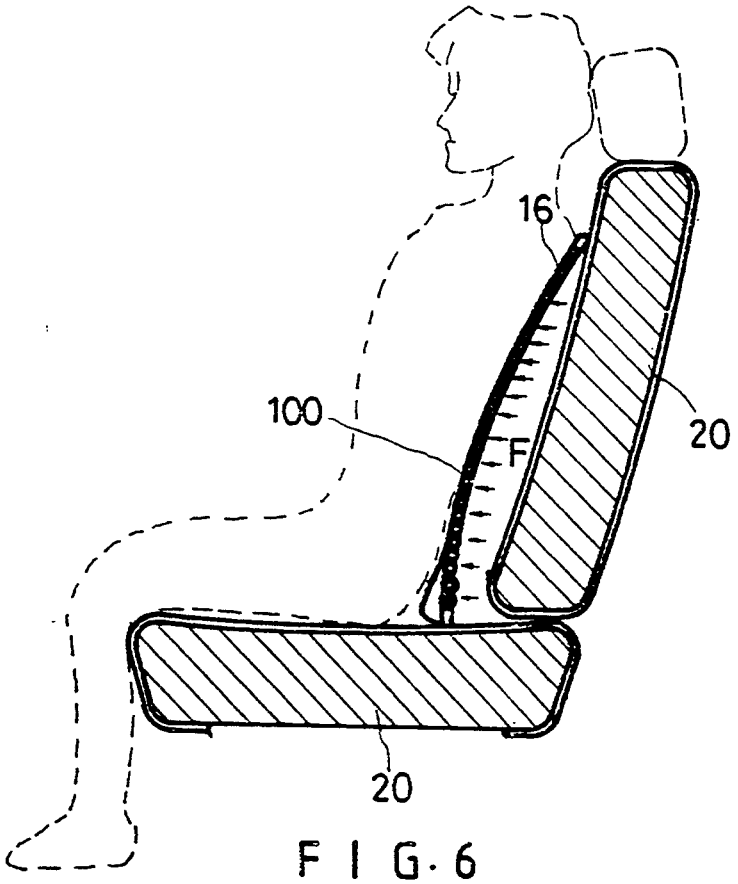
FIG. 6 is a side view of a beaded cushion installed on the seat of a car according to the present invention.
Figure 7:
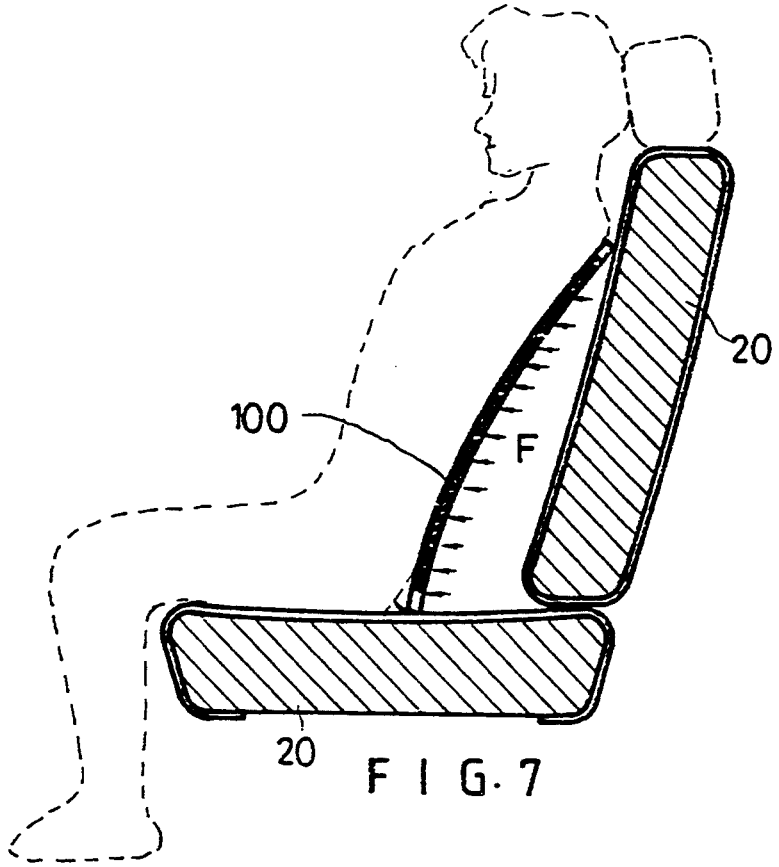
FIG. 7 is a side view of the beaded cushion of FIG. 6 in a different position on the seat in the car according to the present invention.

As shown in FIG. 6, the arcuate cushion (100) with elasticity can be installed on the seat (20) in the car for use. Since this cushion(100 is a separate and movable cushion body, it fits in with various sitting and leaning gestures of the human body including those who are tall, short, fat or lean. Even if anyone feels uncomfortable after he sits and leans thereon for a long time, he can adjust the position of said cushion (100) from time to time (such as changing it in an inclined position as shown in FIG. 7). The cushion of the present invention allows a person to change one's sitting and leaning positons as one likes from time to time, such that all the users can feel its coincident performance and comfortableness regardless of their different physiques. In addition, since the cushion (100) is knitted with the beads (16), it has a plurality of pores or gaps which is instrumental to the heat radiation from the human body. Arrows F in FIGS. 6 and 7 indicate the ventilative effect of the bead construction.

Figure 9:
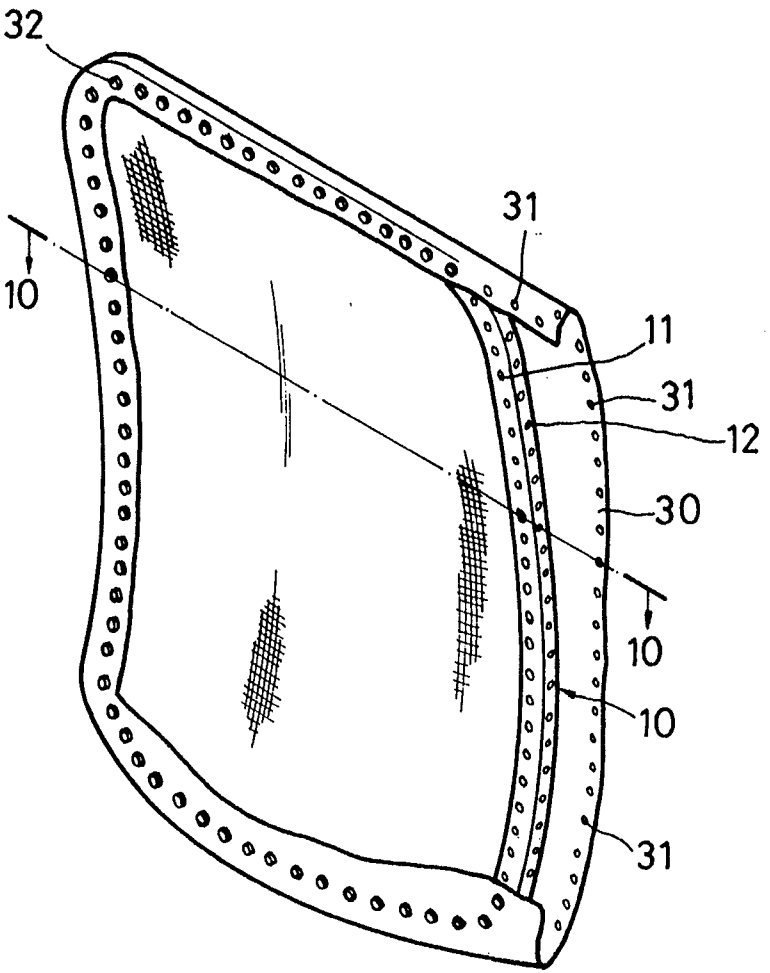
FIG. 9 is a rear perspective view of the FIG. 8 cushion in a partially assembled condition.
Figure 8:
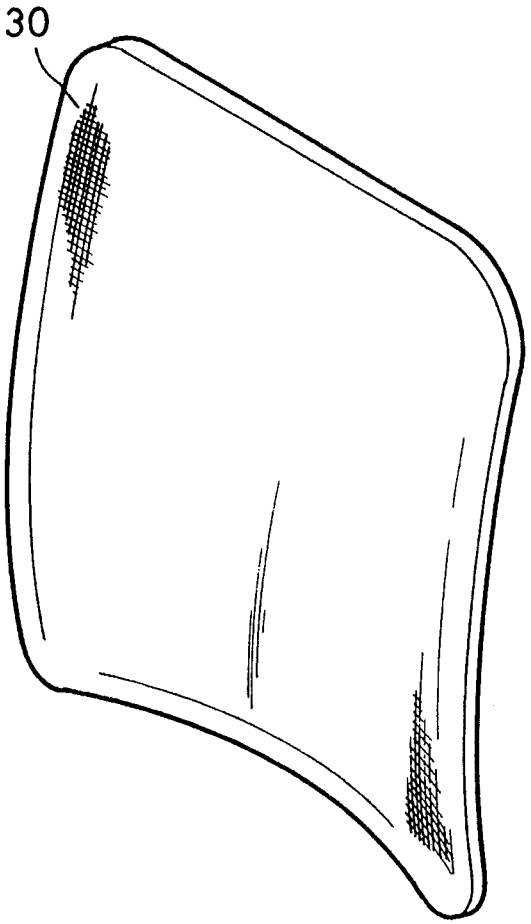
FIG. 8 is a front perspective elevational view of a finished cushion made of textile according to the present invention.

As shown by another example in FIG. 8, 9, and 10 various textiles (such as jean, synthetic leather, nonwoven cloth or network cloth) may be used as the materials to knit the cushion. As shown therein, a plurality of cloth holes (31) are correspondingly provided on the margin of the four sides of textile (30) in keeping with a plurality of longitudinal guide holes (11) in frame body structure (10). To assemble the textile (30) with the frame body structure (10), barded spikes (32) are inserted in the cloth hole (31) of textile (30) and the longitudinal guide hole (11) of frame body structure (10) so as to assemble textile (30) and frame body structure (10) together.

Figure 12:
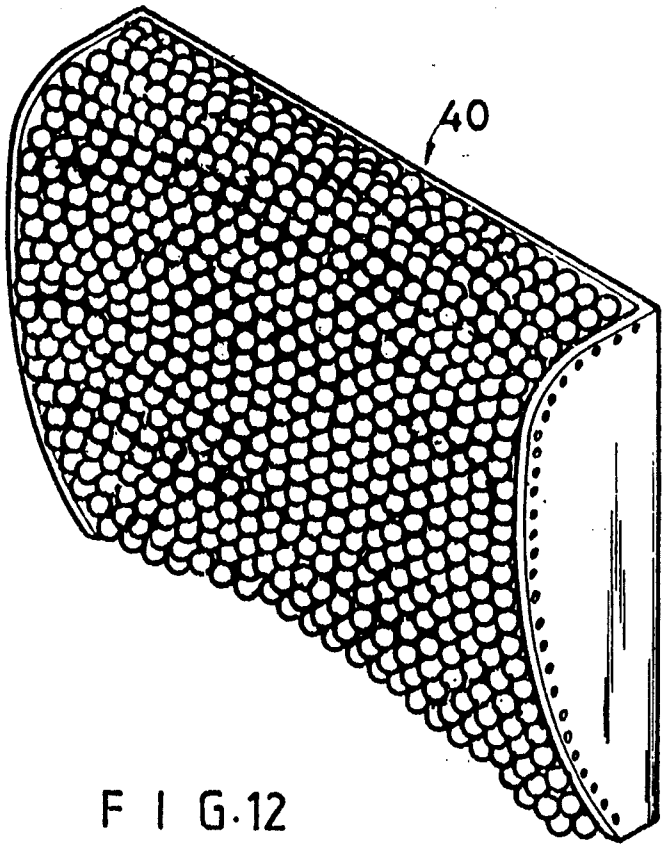
FIG. 12 is a perspective elevational view of the waist-protecting cushion, using the FIG. 11 frame body structure, according to the present invention.
Figure 11:
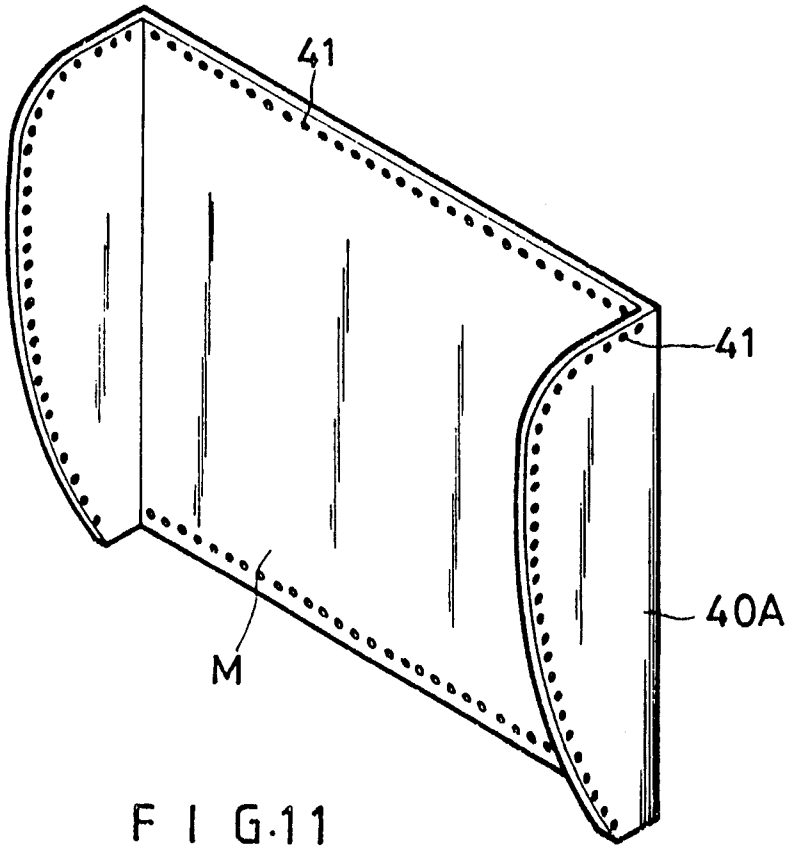
FIG. 11 is a perspective view of a frame body structure of the present invention as a waist-protecting cushion.
Figure 13:
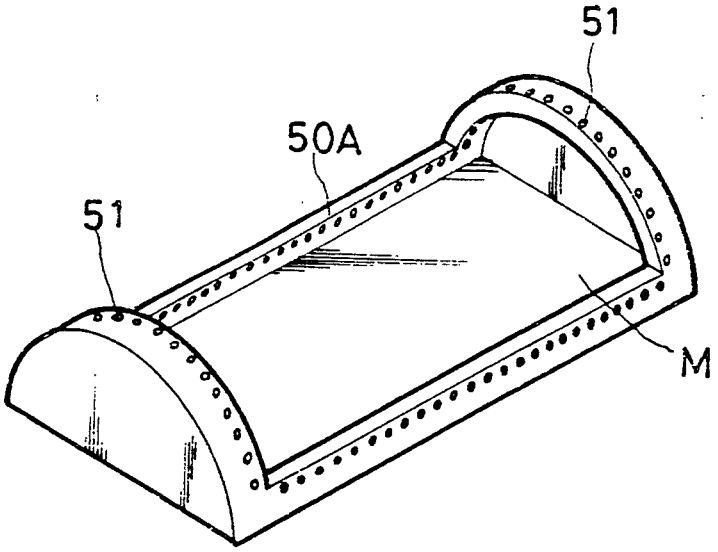
FIG. 13 is a perspective view of a frame body structure of the present invention used in a pillow cushion.
Figure 14:
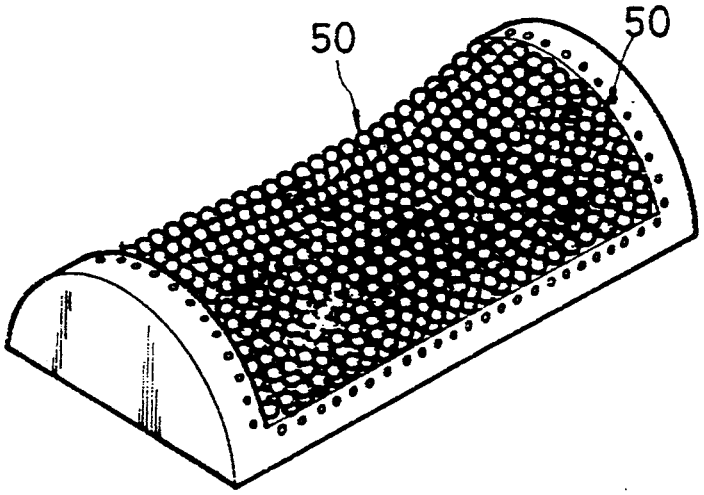
FIG. 14 is a perspective elevational view of a pillow cushion according to the present invention.

As shown in FIG. 11 and 12, a frame body structure 40A is used in a waist-protecting cushion (40). In addition, as shown in FIG. 13 and 14, the frame body structure 50A is used in a pillow cushion (50). As shown in FIGS. 11 through 14, the frame body structure (40A) of said waist-protecting cushion (40) and the frame body structure (50A) of said pillow cushion (50) are integrally moulded, comprising a set of upper and lower frame plates and another set of left and right frame plates which are symmetrical respectively. These two types of frame body structures meet with the arcuate shaping of the human body with a curve (such as in the positions of waist and cervical spine), whereby the central part surrounded by these frame plates forms a hollow part M which is not planar. The waist-protecting cushion (40) and the pillow cushion (50) are elastic and conform with the arcuate human body, so that the user will feel more comfortable.

As shown in FIG. 11, 12, 13 and 14, a plurality of correspondingly longitudinal guide holes (41) and (51) are provided on the frame body structures of said waist cushion (40) and pillow cushion (50) respectively for threading or knitting the beads. The process of knitting the beads is the same as that of knitting the said beaded cushion of FIG. 4, so it is not necessary to repeat it once again.

In view of the above, the frame body structure of elastic arcuate cushion in accordance with the present invention can offer a knitted cushion meeting with the curve of the human body. Its structure is simple but in comparison with the conventional one, the present invention is much more advanced and practical.

I claim:

1. In association with an automobile seat having an upright back for supporting the spinal area of a person seated on said seat: the improvement comprising a portable cushion that includes a rigid rectangular frame having an upper frame section (10A), a lower frame section (10A), and two side frame sections (10B) connected together to form four frame corners; said frame having a front surface and a rear surface; said side frame sections being bowed forwardly from said corners so that said frame front surface has convex curvatures in the planes of said side frame sections; a series of evenly spaced holes extending through said frame sections; a first set of parallel threads extending through said holes in said upper and lower frame sections; first perforated round beads encircling individual ones of said first set of threads; a second set of parallel threads extending through said holes in said side frame sections to intersect said first threads; second perforated round beads encircling individual ones of said second set of threads so as to fit within spaces formed between said first beads; the threads in one set of threads comprising multiple strands (La and Lb) woven around the threads in the other set of threads, whereby the intersecting threads are coplanar, and said round beads present a relatively even surface; said cushion being locatable so that the front surface of said rigid frame faces the spine of a person seated on said automobile seat; said side frame sections being bowed so that the frame follows the curvature of the spine of a person seated on said automobile seat, with said rounded beads presenting a relatively even surface to the spinal area of said seated person.

* * * * *